United States Patent [19]

Gerhardt

[11] 4,056,962

[45] Nov. 8, 1977

[54] ROLLING MACHINE ASSEMBLY

[75] Inventor: Fred Gerhardt, Fresno, Calif.

[73] Assignee: Edeco-West, Inc., Fresno, Calif.

[21] Appl. No.: 776,351

[22] Filed: Mar. 10, 1977

Related U.S. Application Data

[63] Continuation of Ser. No. 714,023, Aug. 13, 1976, abandoned.

[51] Int. Cl.[2] ..... B21D 5/14

[52] U.S. Cl. ..... 72/170; 72/239

[58] Field of Search ..... 72/166, 169–171, 72/237, 173–175, 238, 239

[56] References Cited

U.S. PATENT DOCUMENTS

| | | | |
|---|---|---|---|
| 2,882,767 | 4/1959 | Chatfield | 72/171 |
| 3,279,229 | 10/1966 | Lagher | 72/170 |
| 3,564,889 | 2/1971 | Herburg | 72/174 |
| 3,675,456 | 7/1972 | Sleurin | 72/237 |
| 3,938,362 | 2/1976 | Falk et al. | 72/237 |

*Primary Examiner*—Milton S. Mehr

*Attorney, Agent, or Firm*—Leydig, Voit, Osann, Mayer & Holt, Ltd.

[57] ABSTRACT

A rolling machine assembly for use in a press brake formed of an upper roll subassembly including an upper roll and an upper base and a lower roll subassembly including a pair of lower rolls and a lower base, the bases being detachably secured to the ram and bolster, respectively, of the press brake. Motors of the positive displacement type, fed from a flow divider, rotate the rolls to form a sheet of metal into desired curvature. The lower base has symmetrically located sockets for reception of the tines of a forklift truck so that when the upper roll is in nested position upon the lower rolls, and the securing means are disengaged, the subassemblies may be lifted out of the press brake as a unit by the forklift truck to free the press brake for other usage, and with the reverse procedure being effective for installation.

10 Claims, 7 Drawing Figures

HYDRAULIC CONTROL AND DRIVE

ROLLING MACHINE ASSEMBLY

This is a continuation, of application Ser. No. 714,023, filed Aug. 13, 1976, now abandoned.

A press brake used in metal forming operations, for example, for the purpose of bending or creasing a sheet of metal, includes a heavy frame supporting a stationary elongated bolster mounting a vertically reciprocated ram which is coextensive with the bolster. Longitudinally extensive dies are detachably secured to the bolster and the ram.

A metal rolling machine is, similarly, a piece of heavy equipment having a spaced pair of lower, longitudinally extending rolls anchored to the frame with a third roll spaced above them in centered position and with means for driving the rolls at substantially the same peripheral speed so that when a sheet of metal is interposed between them, the sheet is curved with the degree of curvature depending upon the spacing of the upper roll. A shop for faricating sheet metal requires both types of machines, necessitating a large capital investment.

It is an object of the present invention to provide a rolling machine assembly for rolling a sheet of metal which consists of an upper subassembly and a lower subassembly for individual mounting on the ram and bolster of a conventional press brake, thereby to convert the brake into a rolling machine. It is a related object to provide a rolling machine formed of upper and lower subassemblies detachably secured to the ram and bolster and in which the lower subassembly is provided with symmetrically located sockets for reception of the tines of a forklift truck, so that when the upper roll is nested upon the lower rolls, and the securing means are disengaged, the subassemblies may be lifted out of the press brake as a unit by the forklift truck and deposited in an adjacent storage position to free the press brake for its normal usage, the reverse procedure being effective for re-installation of the rolls in the press brake.

It is a more detailed object to provide a rolling machine assembly consisting of an upper roll subassembly and a lower roll subassembly, with both of these subassemblies having individual hydraulic motors of the positive displacement type which are coupled together by a pair of flexible lines providing a limited degree of free movement between the subassemblies, and with an interposed flow divider so that the rolls of the respective subassemblies are all rotated at substantially the same peripheral speed. It is a related object to provide a rolling machine assembly having hydraulic lines coupled to a fixed source of pressurized fluid which is adjacent to but separated from the assembly to permit convenient transfer between working and storage positions.

It is another detailed object of the present invention to provide a rolling machine assembly which makes use of the stop mechanism normally provided in a press brake for limiting the spacing between the ram and the bolster and thereby determining the degree of curvature which is imparted to the sheet of metal.

It is a general object of the present invention to provide a rolling machine assembly which is capable of rolling heavy sheets of metal on a production basis, but with an investment which is only a small fraction of the investment of a conventional rolling machine and with provision for convenient removal and installation of the assembly, as a unit, upon engagement of the lower subassembly by the tines of a forklift truck, the hydraulic lines remaining intact.

Other objects and advantages of the invention will become apparent upon reading the attached detailed description and upon reference to the drawings in which.

Figure 1:
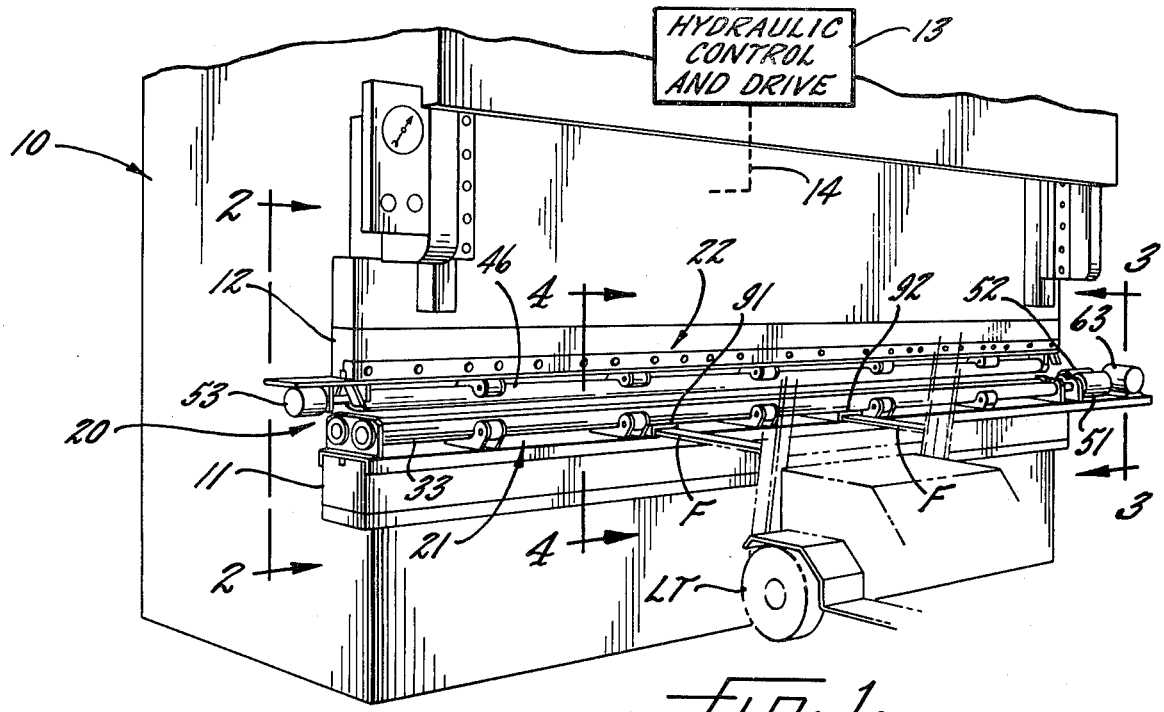
FIG. 1 is a perspective view of the press brake with the rolling assembly installed, and showing a portion of a forklift truck in phantom outline.
Figure 2:
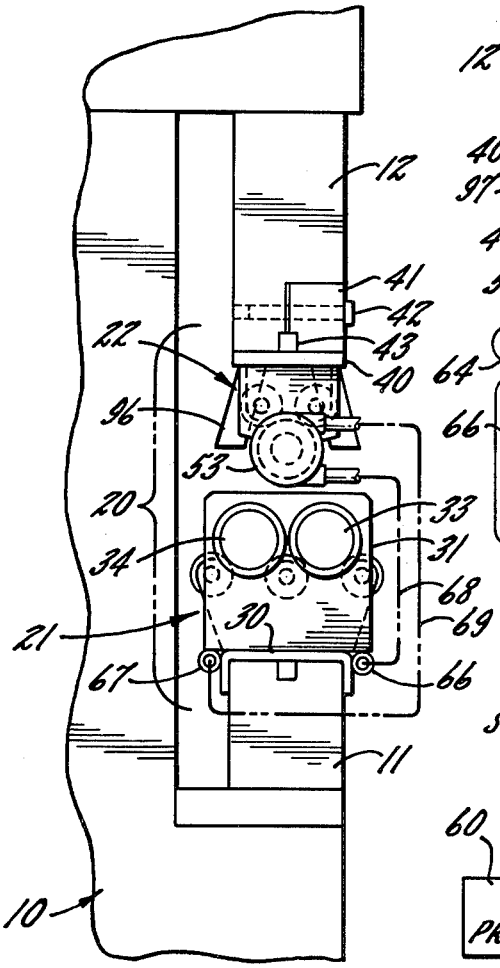
FIG. 2 is a fragmentary end view looking along line 2—2 in FIG. 1.

While the invention has been described in connection with the preferred embodiment, it will be understood that I do not intend to be limited to the particular embodiment shown but intend, on the contrary, to cover the various alternative and equivalent forms of the invention included within the spirit and scope of the appended claims.

Turning now to the drawings, there is shown a press brake 10 of the type normally used for creasing, bending and otherwise forming a sheet of metal. The device has an elongated stationary bed or bolster 11 and a ram 12 coextensive therewith and guided for vertical reciprocating movement above the bolster. The press brake utilized in the present invention will be understood to be conventional, for example a machine in the line manufactured by HTC Copropation. Thus, it will suffice to say a hydraulic control and drive 13 are provided having a mechanical connection 14 with the ram.

In accordance with the present invention the longitudinally extending dies normally provided, and which are secured to the bolster and ram, respectively, are removed and their place is taken by a rolling machine assembly 20 having upper and lower rolls spaced apart by a desired amount for rolling of a sheet of metal into curved shape, the assembly being made up of a lower roll subassembly 21 and an upper roll subassembly 22.

Turning attention first to the lower roll subassembly, it includes a lower base 30 preferably in the form of a shallow inverted channel dimensioned to fit over the bolster 11 with a pair of upstanding brackets or bearing blocks 31, 32. Journaled in the brackets in suitable bearings are a pair of lower rolls 33, 34. The rolls are supported at spaced intervals along their length by intermediate support bearings in the form of rollers 35 mounted upon pedestals 36. The lower subassembly is secure on the bolster 11, being held in place by the downwardly turned flanges of the base, with no additional securement being required.

Turning attention next to the upper subassembly 22, it includes an upper base 40 in the form of a plate which extends along the lower edge of the ram and the lower edge of a coextending mounting bar 41 which is clamped to the ram by means of a series of screws 42, a locating bar 43 connected to the base being interposed between the ram and the mounting bar. Depending from the upper base are two brackets or bearing blocks 44, 45 equipped with bearings for journaling the upper roll 46 in a longitudinally extending position substantially centered between the lower rolls 33, 34. The upper roll 46 is supported against upward bowing movement by means of rollers 47 mounted upon pedestals 48.

For the purpose of driving the rollers 33, 34, 46 at the same peripheral speed, the rollers are equipped with individual hydraulic driving motors of the positive displacement type including a pair of lower motors 51, 52 and an upper motor 53. Such motors are a common item of manufacture and available on the commercial market. The motors 51, 52 are mounted upon a bracket 54, while the upper motor 53 is mounted upon a bracket 55, all with straight-through couplings to the respective rolls.

Figure 3:
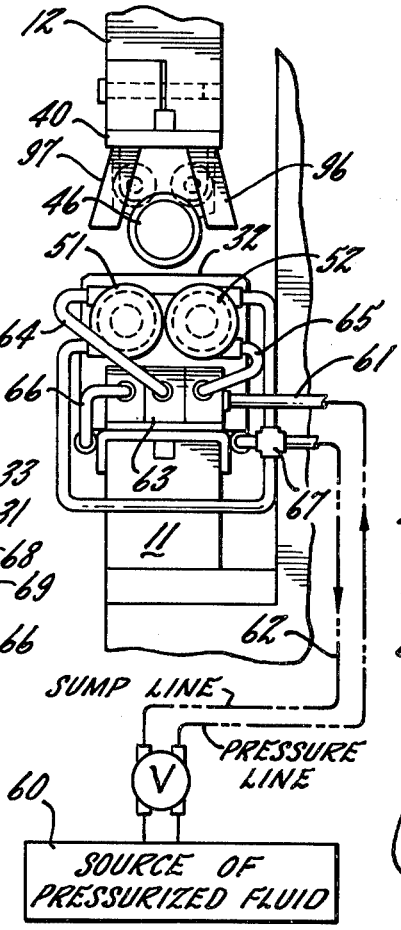
FIG. 3 is an opposite end view looking along line 3—3 in FIG. 1.

In carrying out the invention, a fixed source of pressurized hydraulic fluid is provided having flexible pressure and sump lines which are coupled to the respective connections of the drive motors, and a metering means in the form of a flow divider is interposed in one of the lines to insure metering of the fluid to each of the motors at the same rate. Referring to FIG. 3, the source of pressurized fluid 60 furnishes fluid through a flexible pressure line 61 having a valve V, with fluid being returned through a sump line 62. Interposed in the pressure line 61 is the flow divider 63 having outlet connections 64, 65, 66. The motor returns are all connected to a return manifold 67. The flow divider connection 66 and the return manifold 67 are connected to the upper motor 53 by means of a pair of flexible hoses 68, 69 which have sufficient slack as to provide a limited degree of free movement between the two subassemblies, thereby to accommodate adjustment of the vertical distance between the rolls.

The flow divider 63, it will be understood, is per se well known and available on the commercial market. In its simplest form it can be thought of as consisting of three positive displacement hydraulic pumps, for example, of the well known gear type, having their rotors connected to a common shaft insuring that the same amount of fluid is fed to the outlet connections 64–66 for equal amounts of rotor rotation during equal periods of time.

Figures 5, 6, 7:
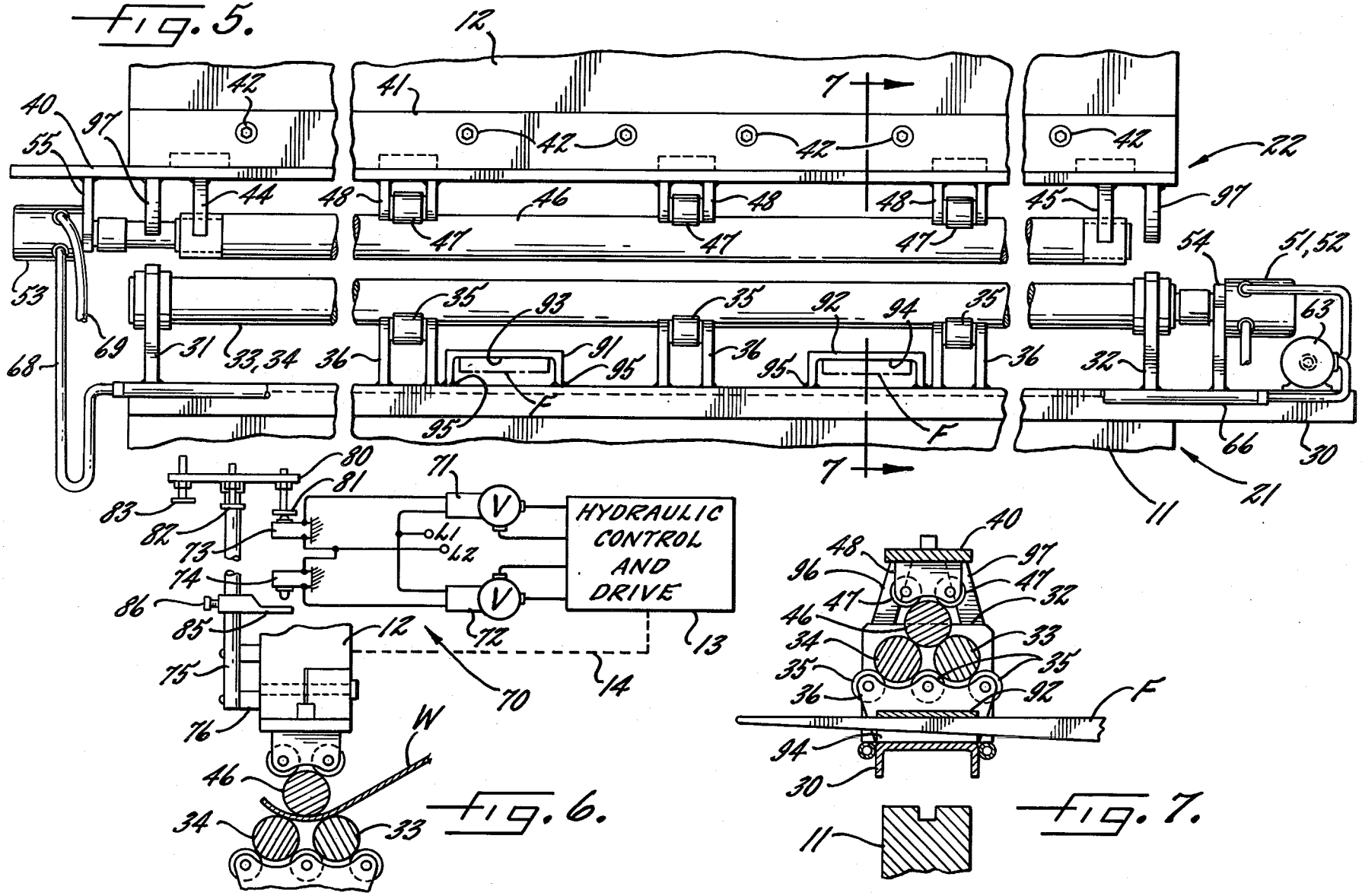
FIG. 5 is a fragmentary, foreshorted, face view of the rolling assembly as installed.
FIG. 6 is a schematic diagram showing the adjusted stop means used for setting of roll height.
FIG. 7 is a fragmentary section taken along line 7—7 in FIG. 5 and showing the rolling assembly engaged by the tine of a forklift truck.

In practicing the invention, means are provided for fixing the upper roll 46 at a predetermined but adjustable spacing above the lower roller 33, 34 by adjusting the height of the ram 12 above the bolster 11. Means for adjusting the lowermost point of the ram stroke is normally provided as part of the press brake and is illustrated in FIG. 6. In the height control system generally indicated at 70, solenoid type control valves 71, 72 connected to the hydraulic control and drive assembly 13 are used to cut off feeding of hydraulic fluid to the ram in the downward and upward directions, respectively. The valves 71, 72 are controlled by limit switches 73, 74 of the "micro" type which are secured to the frame of the press brake.

For cooperating with the microswitch 73, a vertically extending plunger 75 is connected to the ram at its lower end 76 and carries at its upper end a turret 80 having adjustable stops 81, 82, 83 which may be selectively rotated around into active or engaging position with respect to the limit switch 73. In FIG. 6, the limit stop 81 is shown in active position and in contact with the switch 73, thereby to control the solenoid valve 71 to keep the upper roller 46 at the rolling height shown for imparting predetermined curvature to the workpiece W. For defining the upper limit position of the ram, an additional limit stop 85 is provided in the form of a bracket slidably adjustable on the plunger 75 and having a clamping screw 86, the stop 85 being aligned with the limit switch 74 and which, upon engagement, limits movement of the ram in the upward direction.

Figure 4:
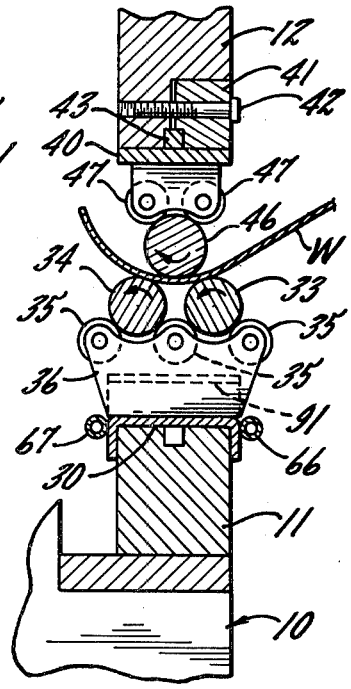
FIG. 4 is a transverse fragmentary section taken along line 4—4 in FIG. 1.

It will be seen, then, that the rolling machine assembly thus far described performs effectively all of the functions normally provided in a complete machine of this type. With the upper roll 46 fixed in position by setting the limit stop 81, and with all of the rolls 33, 34, 46 driven in the direction shown by the arrows in FIG. 4, and at the same peripheral speed, a sheet of metal W will be rolled into predetermined curvature. If desired, the valve V which controls flow in the hydraulic lines 61, 62 may be of the four-way type, thereby to permit simultaneous reversal of the motors which drive the rolls.

In accordance with the present invention, the base of the lower subassembly is provided with symmetrically located sockets for reception of the tines of a forklift truck so that when the upper roll is in nested position with respect to the lower rolls, and the securing means are disengaged, the subassemblies may be lifted out of the press brake as a unit by the forklift truck to free the press brake for other usage, and with the reverse procedure being effective for re-installation of the rolls in the press brake. In the present instance, the sockets (see FIGS. 1, 5 and 7) are indicated at 91, 92 in the form of short sections of inverted channel defining openings 93, 94 and with the sidewalls of the channel being securely welded, at 95, to the upper surface of the lower base member 30. The socket openings 93, 94 are dimensioned to freely and slidably admit the tines F of a lift truck. By locating the sockets symmetrically upon the lower base member 30, the entire rolling assembly is balanced for stable transport.

The convenience provided by the present arrangement will be apparent upon considering a typical removal and re-installation cycle.

For removal, a forklift truck, indicated in phantom at LT in FIG. 1, is driven up to the press brake so that the tines F are inserted into the sockets 91, 92. The limit stop 81 is rotated out of alignment with respect to the limit switch 73 and the normally provided hydraulic control and drive assembly 13 is operated to lower the ram so that the upper roll 46 occupies its lowermost, nested, position with respect to the lower rolls as shown in FIG. 7

The screws 42 which secure the mounting bar 41 to the ram 12 are next unscrewed and the hydraulic control of the press brake is operated to retract the ram 12 upwardly into an out of the way position.

Since the rolling machine assembly consisting of the nested lower and upper subassemblies is fully self-contained and since the subassemblies are now nested together as a unit, they may be removed as a unit promptly and without any further preparation. The tines of the lift truck are raised thereby unseating the lower base 30 from the bolster 11, as shown in FIG. 7, and the forklift is simply backed away with its load. The removed assembly may be deposited by the truck in any free position adjacent the press brake. In accordance with one of the detailed features of the invention, the pressure and sump lines 61, 62 may be flexible, and sufficiently long so as to stay within range of the source 60, so that the hydraulic system of the assembly need not be disconnected.

The bolster 11 and ram 12 are thus freed for mounting of the dies normally used in the press brake, until such time as a rolling operation is again required.

Installation of the rolling assembly is equally simple: The forklift truck, with the tines of the fork lowered to register with the sockets 91, 92, is advanced so that the tines are entered to a convenient depth in the sockets (FIG. 7), following which the assembly is lifted to slightly above bolster level and maneuvered into position to seat the lower frame 30 into registered position on the bolster, following which the lift truck is backed away. The ram 12 of the press brake is then lowered under manual control into engagement with the upper base member 40 and the clamping screws 42 are screwed in place. The appropriate, and preadjusted, one of the limit stops 81–83 on turret 80 is rotated into alignment with the limit switch 73 for raising the upper subassembly into the working position illustrated in FIG. 4 so that rolling may begin.

Both the removal and the installation of the rolling machine assembly is a matter which can be accomplished within a few minutes time and which does not require any particular skill or experience. To prevent the upper subassembly 22 from rolling or toppling off the lower subassembly 21 when being moved by the truck LT, bars 96 and 97 depend from the upper base 40 outboard of the bearing blocks 44, 45 and straddle the axis of the upper roll 46. When the upper subassembly is lowered onto the lower subassembly, the lower ends of the bars rest on flat surfaces on the upper ends of the bearing blocks 31, 32 to provide stable support for the upper subassembly.

It will be seen that the present invention provides a high degree of economy along with convenience and effectiveness. While the rolling assembly, installed in place, possesses most of the operating features of a commercial rolling machine, the assembly may be constructed at a cost which is only a fraction of that of the entire machine. There is also a substantial saving in floor space. Where the assembly, while idle, is stored adjacent the press brake, the hydraulic lines 61, 62 may, as stated, remain intact. However, the invention is not limited thereto and the lines 61, 62 may be provided with quick-disconnect hydraulic couplings permitting the assembly to be stored in a more remote location. And if desired, several roller assemblies having differently-sized rollers, may be used in the same press brake.

The term "motor" as used herein includes a motor consisting of two separate sections 51, 52. The term "channel" as used herein includes any securing member forming a socket having a cross section characteristic of a channel, regardless of axial length.

I claim:

1. A rolling machine assembly for rolling a sheet of metal into curved cross section and for use in a press brake having an elongated bolster and a ram coextensive therewith with powered means for reciprocating the ram and with adjustable stop means for positioning the ram at a predetermined elevation comprising, in combination, a lower roll subassembly including a pair of lower rolls and a lower base member with upstanding bearing blocks for supporting the lower rolls in slightly upraised position and laterally spaced from one another, an upper roll subassembly including an upper roll and an upper base member having bearing blocks thereon for supporting the upper roll in a depending position from the ram and centered between the lower rolls, means for detachably securing the lower base member to the bolster, means for detachably securing the upper base member to the ram, a lower hydraulic motor secured to the lower base member for driving the lower rolls, an upper hydraulic motor secured to the upper base member for driving the upper roll, the motors being of the positive displacement type, means for metering hydraulic fluid to the motors for rotation of the rolls at substantially the same peripheral speed, the lower base member having symmetrically located sockets for reception of the tines of a forklift truck so that when the upper roll is in nested position with respect to the lower rolls, and the securing means are disengaged, the subassemblies may be lifted out of the press brake as a unit by the forklift truck to free the press brake for other usage, and with the reverse procedure being effective for re-installation of the subassemblies in the press brake.

2. The combination as claimed in claim 1 in which each roll has its own drive motor of hydraulic positive displacement type, the drive motors having inlet and outlet connections, a source of hydraulic fluid including flexible pressure and sump lines coupled to the respective connections, the metering means being in the form of a flow divider interposed in one of the lines for insuring rotation of the rolls at substantially the same peripheral speed.

3. The combination as claimed in claim 2 in which the two subassemblies are permanently joined by a pair of flexible hoses for circulation of fluid to the upper hydraulic motor with sufficient slack in the hoses to provide a limited degree of free adjusting movement between the subassemblies.

4. The combination as claimed in claim 1 in which the sockets are in the form of shallow inverted channels interposed between the lower rolls and the lower base member and having sidewalls which are secured to the upper surface of the lower base member.

5. The combination as claimed in claim 1 in which the source of pressurized fluid is fixed in a position adjacent to but separated from the subassemblies and in which flexible pressure and sump lines lead from the source to the lower subassembly with sufficient slack as to accommodate movement of the subassemblies as a unit between working and storage positions free of any necessity for disconnecting the lines.

6. A rolling assembly for rolling a piece of metal into curved cross section and for use in a machine having a bed and a ram with means for raising and lowering the ram comprising, in combination, a lower roll subassembly including lower roll means and a lower base member with bearings for supporting the lower roll means above the base member, said lower base member being releasably mountable on the bed, an upper roll subassembly including an upper roll subasseblies may and an upper base member having bearings thereon for supporting the upper roll means in a depending position below the upper base member, means for detachably securing the upper base member to the ram, lower motor means secured to the lower base member for rotating the lower roll means, an upper motor secured to the upper base member for rotating the upper roll means, the lower subassembly having means for reception of the tines of a forklift truck so that when the upper roll means is resting on the lower roll means, and the securing means are disengaged, the subassemblies may be lifted out of the machine as a unit by the forklift truck to free the machine for other usage, and with the reverse procedure being effective for re-installation of the subassemblies in the machine.

7. A rolling assembly for rolling a piece of metal into curved cross-section and for use in a machine having a bed and an overlying ram with means for raising and lowering said ram, said assembly comprising a lower roll subassembly including a lower base member and lower roll means, lower bearings on said lower base member for rotatably supporting said lower roll means above said base member, lower motor means supported on said lower base member for rotating said lower roll means, said lower base member being releasably mountable on said bed to enable said lower base member, said lower bearings, said lower roll means and said lower motor means to be removed as a unitary subassembly from said bed, an upper roll subassembly including an upper base member and upper roll means, upper bearings on said upper base member for rotatably supporting said upper roll means in a depending position below said upper base member, upper motor means supported on said upper base member for rotating said upper roll means, and means securing said upper base member to said ram and selectively releasable to permit said upper base member, said upper bearings, said upper roll means and said upper motor means to be detached as a unitary subassembly from said ram when said upper roll means is resting on said lower roll means whereby said upper subassembly may be removed from said machine as a unit with said lower subassembly.

8. A rolling assembly as defined in claim 7 in which said lower roll means comprise first and second radially spaced lower rolls and in which said lower motor means comprises first and second hydraulic motors for rotating the respective rolls, said upper roll means comprising an upper roll which is centered relative to said lower rolls, and said upper motor means comprising a hydraulic motor for rotating said upper roll.

9. A rolling assembly as defined in claim 7 in which said lower base member is mountable on the elongated bolster of a press brake having a ram which is coextensive with said bolster and which is adapted to be releasably secured to said upper base member.

10. A rolling assembly as defined in claim 7 in which said lower base member includes means for receiving the tines of a forklift truck.

* * * * *